United States Patent [19]

Torisawa et al.

[11] 4,217,751

[45] Aug. 19, 1980

[54] ELECTRONIC TIMEPIECE

[75] Inventors: Akira Torisawa; Makoto Ueda; Kazuhiro Asano; Katsuhiko Satoh; Masaaki Mandai; Masaharu Shida, all of Tokyo, Japan

[73] Assignee: Kabushiki Kaisha Daini Seikosha, Tokyo, Japan

[21] Appl. No.: 898,438

[22] Filed: Apr. 20, 1978

[30] Foreign Application Priority Data

Apr. 23, 1977 [JP] Japan ..... 52-47091

[51] Int. Cl.[2] ..... G04C 3/00

[52] U.S. Cl. ..... 368/76; 340/663; 368/218

[58] Field of Search ..... 58/234 D, 234 BA, 234 R, 58/152 H; 340/636, 663, 672, 373; 318/696, 685

[56] References Cited

U.S. PATENT DOCUMENTS

| | | | |
|---|---|---|---|
| 3,662,245 | 5/1972 | Newell | 318/696 |
| 4,032,827 | 6/1977 | Dobratz | 318/696 |

*Primary Examiner*—J. V. Truhe
*Assistant Examiner*—L. W. Pojunas, Jr.
*Attorney, Agent, or Firm*—Robert E. Burns; Emmanuel J. Lobato; Bruce L. Adams

[57] ABSTRACT

In an electronic timepiece having a stepping motor, a drive pulse is produced for normally driving the motor, a detecting pulse is generated for detecting whether the motor has rotated in response to the last drive pulse and a correction pulse is produced for driving the motor when non-rotation has been detected. A current limiting resistor is disposed in series with the motor for limiting the current thereto and a switching transistor is connected across the current limiting resistor to short circuit same to effect an increase in the current to the motor. During the detecting pulse, the voltage across the current limiting resistor is compared to a predetermined value. If the voltage is above the predetermined value, which indicates that the motor has not rotated in response to the last drive pulse, the switching means is actuated to short circuit the current limiting resistor and the correction pulse is applied to the motor during the resulting increased current condition so that the motor will be enabled to rotate even when a higher torque load is applied thereto. In this way, a decreased amount of current is used during the normal torque loading condition on the motor.

5 Claims, 10 Drawing Figures

FIG. 6
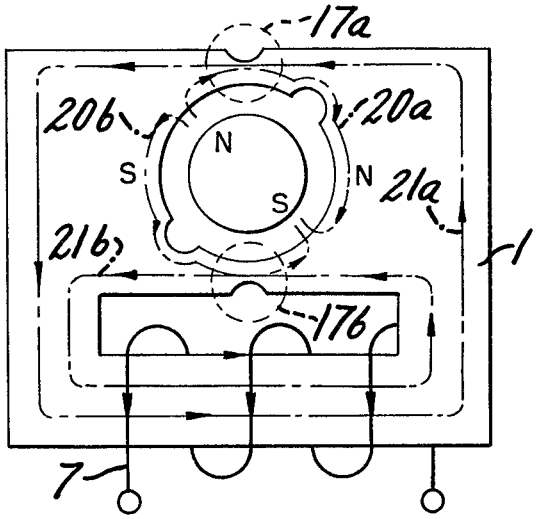
FIG. 7
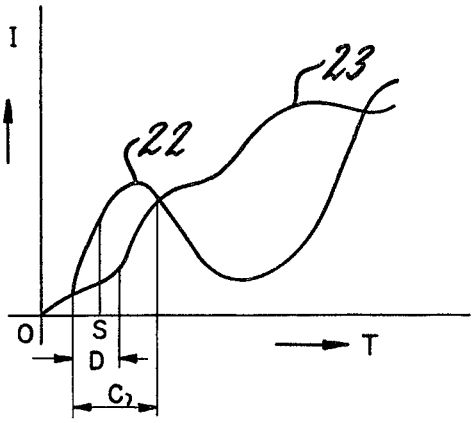
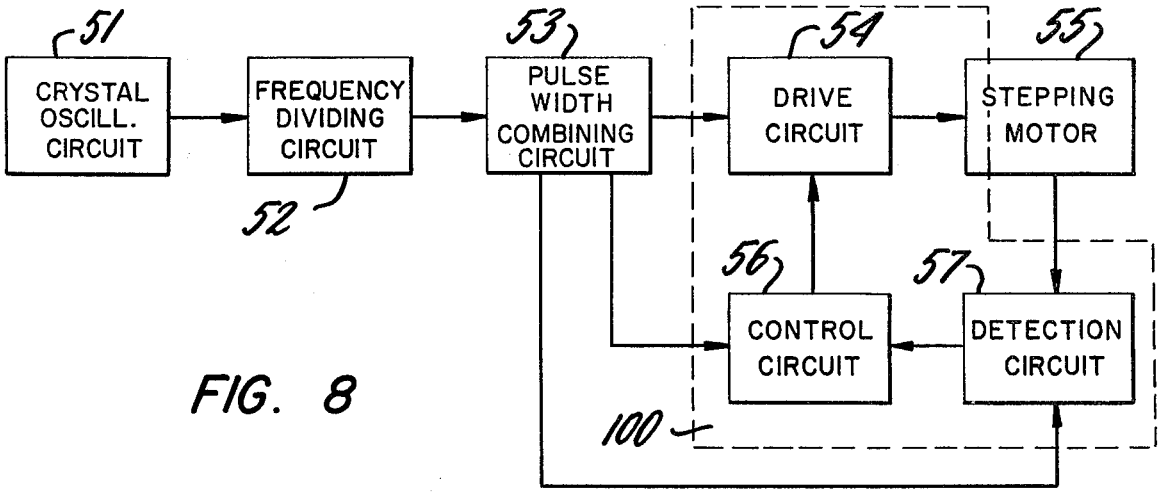
FIG. 8

ELECTRONIC TIMEPIECE

BACKGROUND OF THE INVENTION

The present invention relates to an improvement in an electronic watch in which the power consumption of a stepping motor is reduced.

The present invention will be explained on the basis of an embodiment applying the principles of the present invention to an analogue type electronic watch.

The display mechanism of an analogue type crystal watch heretofore used is generally constructed as shown in FIG. 1. The output of the motor comprising a stator 1, a coil 7 and a rotor 6 is transmitted to a fifth wheel 5, a fourth wheel 4, a third wheel 3 and a second wheel 2. Although not shown, the output is then transmitted to a cylindrical member, a cylindrical wheel, and a calendar mechanism whereby a second hand, a minute hand, an hour hand and a calendar are driven.

In the case of wrist watch, a load seen from the stepping motor is extremely small except for the time for switching the calendar, so that a torque of 10 g/cm in the second wheel is sufficient for the driving. However, when switching the calendar, a torque which is several times greater than this is required. The time required for switching the calendar within twenty-four hours operation per day is only at most about six hours. However, for the reasons described above in the mechanism according to the prior art, there is a problem that electric power which enables the calendar driving mechanism to be operated in a stable condition must always be supplied from a power supply.

FIG. 2 shows an electronic watch circuit construction according to the prior art. The signal of 32.768 KHZ from an oscillation circuit 10 is converted to one second signal by a frequency dividing circuit 11. The one second signal is converted to a signal having a width of 7.8 m sec and a period of 2 seconds by a pulse width combining circuit 12, and the signal along with a signal having the same period and pulse width but being dephased by one second are applied to the inputs 15 and 16 of inverters 13*a* and 13*b*. As a result, an inverted pulse which changes the direction of the current is applied to a coil 14 once every second, so that the rotor 6 magnetized in two poles rotates in one direction. FIG. 3 shows the current waveform therefor. In this manner, the drive pulse width of the present day electronic watch is set by the required maximum torque as its standard. Therefore, in the time interval which does not require a large torque, electric power is wasted. This has prevented a lower power consumption for the watch.

SUMMARY OF THE INVENTION

In order to overcome this noted difficulty and insufficiency, in the electrode watch according to the present invention, a motor is driven by a drive circuit having a resistor in series for reducing current, and afterwards a detected pulse is applied to a coil so as to determine rotation of the rotor, and the rotation of the rotor is detected by a voltage level across the resistor connected in series with the drive circuit and if the rotor fails to rotate, a correction is effected by driving the motor for increasing the current by short circuiting the resistor.

BRIEF DESCRIPTION OF THE DRAWINGS

FIGS. 4, 5 and 6 show operations of the stepping motor,

FIG. 7 shows the current waveforms of the rotor of normal rotation and non-rotation, FIG. 8 shows an overall block diagram of one embodiment of the electronic watch according to the present invention.

DETAILED DESCRIPTION OF THE INVENTION

The principle of the rotation of a stepping motor for use in the electronic watch according to the present invention is described as follows with respect to FIGS. 4–10.

Figure 4:
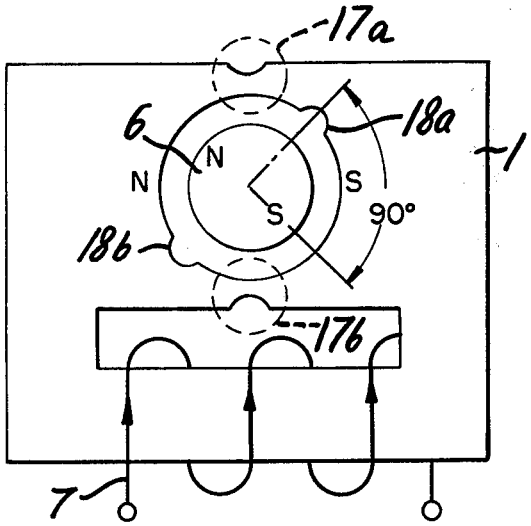

Referring to FIG. 4, numeral 1 shows a stator constructed in one integral body having a magnetic path or circuit 17*a*, 17*b* which is easily saturable. The stator is magnetically engaged with a magnetic core with the coil 7. In order to determine the direction of the rotation of the rotor 6 with two magnetic poles provided in the direction of the diameter, a notch 18*a*, 18*b* is provided in the stator. In FIG. 4, the condition is shown in which electric current has just been applied to the coil 7. When no current is applied to the coil 7, the rotor 6 remains stationary at the position of approximately 90 degrees in angle between the notch 18*a*, 18*b* and the magnetic poles of the rotor.

Figure 1:
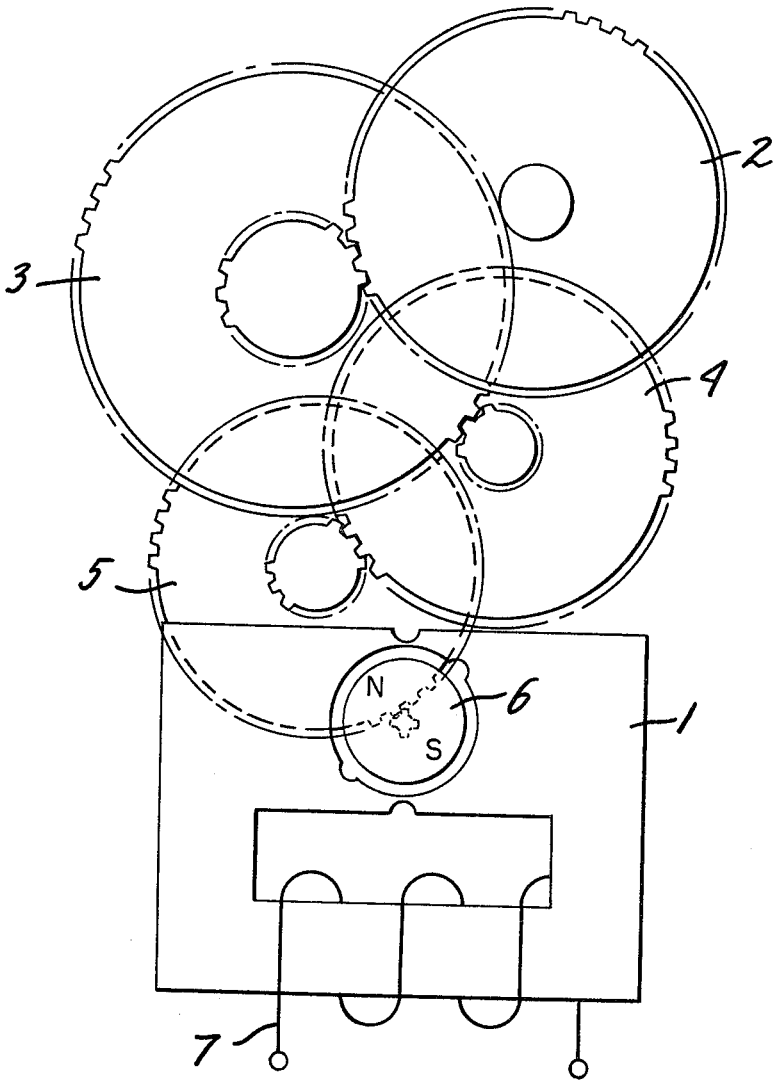
FIG. 1 PRIOR ART
FIG. 1 shows a display mechanism of an analogue type cyrstal watch.
Figure 2:
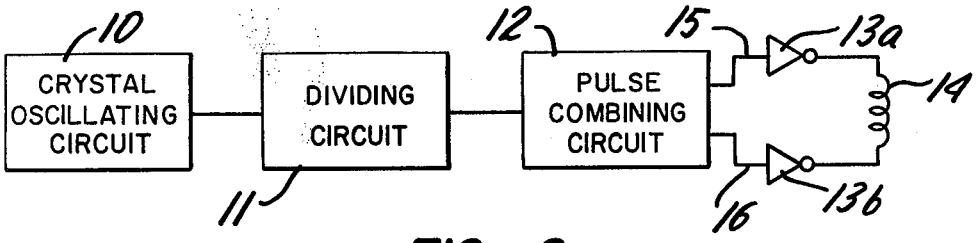
FIG. 2 PRIOR ART
FIG. 2 shows a circuit construction of an electronic watch.
Figure 3:
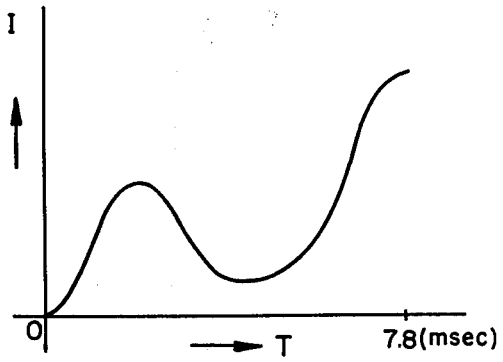
FIG. 3 PRIOR ART
FIG. 3 shows a current waveform of the conventional stepping motor.

In this condition, when, in the coil 7, the current flows in the direction of the arrow mark, the magnetic poles are produced in the stator 1 as shown in FIG. 4, so that the rotor 6 rotates clockwise by repulsing action of the poles with respect to each other. When the current flowing through the coil 7 is interrupted, the rotor 6 will station itself of the reversed condition in the magnetic poles against the previous condition in FIG. 4. Afterwards, the rotor 7 keeps sequentially rotating in the clockwise manner by the current flowing in the opposite condition. Since the stepping motor used in the electronic watch according to the present invention is constructed in one integral body having saturable portion 17*a*, 17*b* the current waveform flowing through the coil 7 presents a characteristic with the slow rising curve as shown in FIG. 3.

The reason for this is that before the saturable portion 17*a*, 17*b* of the stator 1 saturates, the magnetic resistance of the magnetic circuit seen from coil 7 is very small, so that the time constant $\tau$ of the series circuit of the resistor and the coil becomes very large. The equation of this condition can be expressed as follows:

$$\tau = L/R,\ L = N^2/Rm$$

Therefore, the following equation is established:

$$\tau = N^2/(R \times Rm)$$

where L denotes the inductance of the coil 7, N is the number of turns of the coil 7 and Rm is magnetic resistance.

When the saturable portion 17*a*, 17*b* of the stator 1 is saturated, the permeability of the portion becomes the same as that of the air. Accordingly, Rm increases and the time constant $\tau$ of the circuit becomes small and the waveform of the current rises abruptly as shown in FIG. 3.

According to the present invention, the detection of the rotation or non-rotation of an rotor 6 for use in the electronic wristwatch is found by the difference of the time constant of the circuit consisting of the resistor and coil connected in series. The reason for producing a difference in the time constants will now be explained hereinafter.

Figure 5:
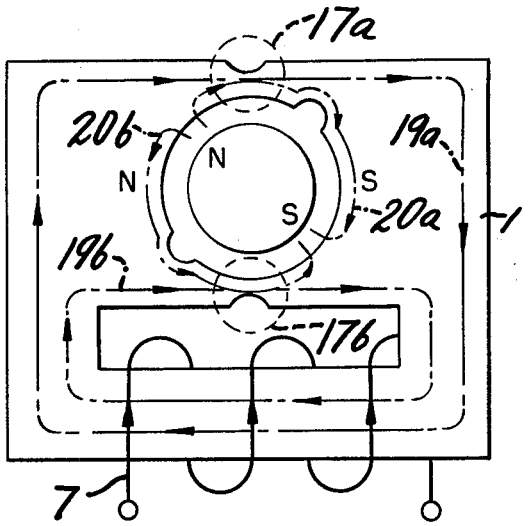

FIG. 5 shows a magnetic field at the time of current flow through the coil 7. In the figure, the rotor 6 is in the position which is rotatable against the magnetic poles. The magnetic fluxes 20*a*, 20*b* are the ones which are derived from the rotor 6. The magnetic flux which intersects the coil 7 also exists practically, however, this is neglected here. The magnetic fluxes 20*a* and 20*b* are shown as being derived from the saturable portions 17*a* and 17*b* of the stator 1 and they are directed as shown by the arrow mark. The saturable portion 17*a*, 17*b* is, in most cases, not in the saturated condition. In this condition, the current flows in the direction of the arrow mark of the coil 7 so as to rotate the rotor 6 clockwise. The magnetic fluxes 19*a* and 19*b* produced by the coil 7 are added to the magnetic fluxes 20*a* and 20*b* produced by the rotor 6 within the saturable portion 17*a* and 17*b*, so that it rapidly saturates. Afterwards, the magnetic flux which is sufficient for rotating the rotor 6 is produced. However, this is omitted in FIG. 5. FIG. 7 shows the waveform of the current flowing through the coil, as numeral 22.

FIG. 6 shows the condition of the magnetic flux in which the current is flowing through the coil 7 at the time when the rotor 6 could not be rotated for some reason and is returned to the original point. Generally, in order to rotate the rotor 6, the current must be flowing in the coil 7 in the opposite direction against arrow mark, i.e. in the same direction as that as shown in FIG. 5. However, in this case since as alternating inverted current is applied to the coil 7 for every rotation, this condition occurs whenever the rotor 6 can not be rotated. Since the rotor 6 could not be rotated in this case, the direction of the magnetic flux producing from the rotor 6 is the same as the one shown in FIG. 5. In this case, since the current is flowing in the opposite direction against FIG. 5, the direction of the magnetic fluxes become 21*a* and 21*b*. In the saturable portion 17*a* and 17*b*, the magnetic fluxes produced respectively from rotor 6 and the coil 7 cancel each other out, so that in order to saturate that portion of the stator 1, a longer time is required.

FIG. 7 shows this condition as waveform 23. In this embodiment, the time interval "D" before the portion 17 of the stator 1 saturates in FIG. 7 was 1 m sec on the condition that the diameter of the coil is 0.23, number of turns is 10000, the coil resistance is 3KΩ, the diameter of the rotor is 1.3 and the minimum width of the saturable portion is 0.1. As is apparent from the waveforms 22 and 23 of the two currents in FIG. 7, the inductance of the coil is small when the rotor 6 is rotating within the range of "C" in FIG. 7 while it is larger at the time of non-rotation. In the stepping motor as described above, the equivalent inductance in the range of "D" was chosen as L=5 henry at the current waveform of 22 when rotating, and was chosen as L=40 henry at the waveform 23 during non-rotation. For instance, when the resistor "r" as a passive element for the detection and the coil series resistor "R" are connected in series to the inductance through the power supply $\overline{V}D$, the change in inductance is easily detected by the voltage appearing across the resistor element for detecting the threshold value $\overline{V}th$ of a MOS inverter, i.e. $\frac{1}{2}\overline{V}n$ voltage.

As it is apparent from the above description, rotation or non-rotation of the rotor 6 is to be determined by applying a detection signal, so that it is possible to drive the rotor in a low torque by applying a pulse with a small current as well as to amend the driving in high torque by a pulse with a normal current to effect rotation of the motor.

FIG. 8 shows the block diagram of an overall electronic watch. A crystal oscillating circuit 51 oscillates a signal which is used as a standard signal of the watch. A frequency dividing circuit 52 is constructed by multistage flip flops which can divide up to one second for the oscillating signal required for a watch. A pulse width combining circuit 53 combines each flip flop output of the frequency dividing circuit, to produce a normal drive pulse signal with the pulse width necessary for the driving, a drive pulse signal for the correcting drive, a detection pulse signal with a duration necessary for the detection, a time interval setting signal between the normal drive pulse and the detecting pulse, and a time interval setting signal between the detecting pulse and the correcting drive pulse, etc.

A drive circuit 54 supplies the normal drive pulse, the detecting pulse, or the correcting drive pulse as an inverted pulse to the stepping motor.

The rotor of the stepping motor 55 is rotated by the application of the normal drive pulse when the load is low. However, the rotor is not rotated when the load is high, so that it is possible to detect either the rotating condition or the non-rotating condition of the rotor from the difference of the coil depending on the above condition by applying the detecting signal to the detection circuit 54. Accordingly, when the load of the motor increases for some reasons and the rotor is not rotated at the time of applying the normal drive pulse, either the rotating or non-rotating condition of the rotor is detected by applying the detecting pulse immediately after the drive pulse has been applied. In this case, when the rotor is not rotated, the resistor which is connected to the drive circuit in series is short circuited, the correction drive pulse is applied to the rotor from the control circuit 56 for the correction drive. In the embodiment of the electronic watch according to the present invention, the direction of the detection pulse is set in the same direction as that of the drive pulse, but it is also possible for the direction of the drive pulse to be reversed.

In the present embodiment, the pulse width combining circuit 53 can be easily constructed by the direct use of the pulses, such as 1 m sec, 3.9 m sec, 7.8 m sec and 31 m sec which is obtainable from the output of the crystal oscillates at circuit 51 which oscillates at 32.768 KHZ. A detailed circuit thereof is omitted.

Figure 9:
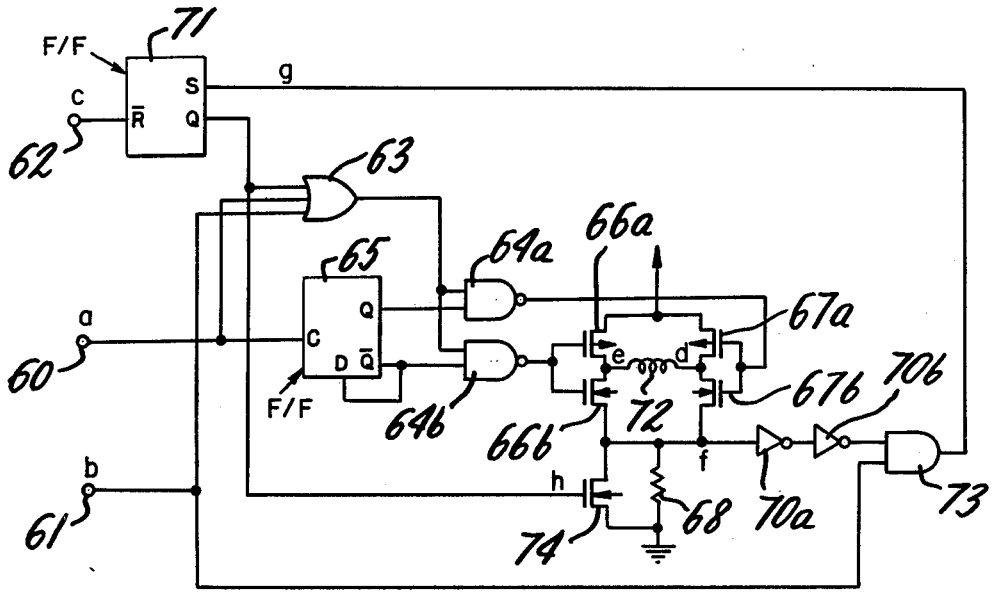
FIG. 9 shows a circuit construction of one embodiment of the present invention.

FIG. 9 shows an embodiment of the motor control circuit 100. The drive circuit 54 consists of NAND gates 64*a* and 64*b*, a flip flop 65, drive inverters 66*a*, 66*b* and 67*a*, 67*b*. The motor 55 is provided with the coil 72.

Figure 10:
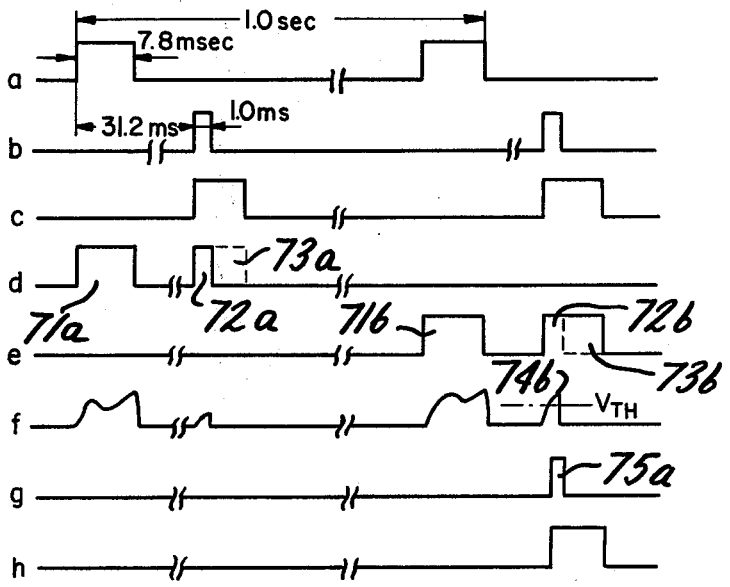
FIG. 10 shows a time chart of a circuit.

The detection circuit 57 comprises inverters 70*a*, 70*b* and gate 73, a transistor 74 as a switching element and a resistor element 68. The control circuit 56 is constructed by a flip flop 71 and an OR gate 63. FIG. 10 shows a timing chart of each portions of FIG. 10.

To terminals 60, 61 and 62 is timely applied the normal drive pulse, the detecting pulse and the correction drive pulse as shown in FIGS. 10*a*, 10*b* and 10*c*. These signals are combined by OR gate 63 and also phases thereof are selected by flip flop 65 and NAND gates 64*a* and 64*b*. These signals are applied to the terminal of the coil 72 through the drive inverters 66*a*, 66*b* and 67*a*, 67*b* as shown in FIGS. 10*d* and 10*e*. The rotor is rotated normally one step by the drive pulse 71*a*.

When the voltage at "f" overcomes a threshold value of the inverter 70*a* when the normal drive pulse is applied to the coil 72, however, since one input of AND-gate 73 is maintained at the 0-level as indicated in the terminal "b", the a voltage of "g" is not changed. The detection circuit is constructed so as to operate only when a detection signal has appeared at the terminal "b". When the detection pulse 72*a* is applied there to, the relationship of the magnetic pole is as indicated in FIG. 6, whereby a voltage of "f" does not rise to a threshold value of the inverter 70*a* and the terminal "S" of the flip flop 71 is not changed. Accordingly, the correction drive pulse is not applied to the coil 72. If the rotor was not rotated in the stepping operation for some reason, the relationship of magnetic pole is as indicated in FIG. 5 when the detection pulse 72*b* was applied thereto, whereby a voltage of "f" becomes the same level of the threshold of the inverter 70*a*, and the output thereof is reversed. A voltage of output "g" of AND-gate 73 rises to the "1" level, a set signal 75*a* is applied to the flip flop 71. Further the output "$\overline{Q}$" of the flip flop 71 rises, a correction drive pulse h is applied to the coil 72 through NOR gate 63, further transistor 74 turns ON by the output "Q", whereby the resistor 68 is shorted. It is then possible to flow a larger current than the normal drive condition to the coil 72 according to the above noted operation.

According to the present invention, the resistor 68 is used as a passive detection element and a current reduction element, the transistor 74 and is used as a switching element, it is possible to replace these elements by a MOS transistor. In this case, one is able to omit the resistor 68 of FIG. 10 by designing the ON-resistance of a MOS-transistor to nearly zero and OFF-resistance of MOS-transistor to 2KΩ.

Therefore, the location of a rotor is easily acknowledged without using an amplifier whereby a power consumption is remarkably reduced.

Further, in spite of the kind of motor, an electronic timepiece including a motor have a difference of inductance of a coil of a rotor is completely involved to the scope of the present invention.

We claim:

1. An electronic timepiece comprising: a stepping motor; an oscillating circuit for producing a time base signal, a dividing circuit for dividing down the time base signal; a drive circuit for driving the stepping motor including a power source, a pair of two series-connected driving transistors, a resistance element for limiting current from the power source and a transistor connected in parallel with the resistance element for short-circuiting same; means for comparing the voltage across the resistance element with a predetermined voltage to control the short-circuiting transistor to short circuit the resistance element when a favorable comparison is made indicating non-rotation of the motor.

2. In an electronic timepiece of the type having an oscillator for producing a time base signal and a stepping motor, the improvement comprising: means for limiting the current to the motor; means receptive of the time base signal for producing a drive pulse for the motor sufficient to drive same under normal torque loading with the limited current, a correction pulse and a detecting pulse; switching means for bypassing the current limiting means to effect an increase in the current to the motor; means responsive to the detecting pulse for comparing the voltage across the current limiting means with a predetermined value wherein a voltage below the predetermined value indicates that the motor rotated in response to the last drive pulse and a voltage above the predetermined value indicates that the motor did not rotate in response to the last drive pulse and for producing a comparison signal when non-rotation is sensed; and means responsive to the comparison signal for controlling the switching means to bypass the current limiting means and to effect application of the correction pulse to the motor during the resulting increased current condition.

3. The timepiece according to claim 2; wherein the current limiting means comprises a resistance element.

4. The timepiece according to claim 3; wherein the switching means comprises a transistor connected across the resistance element.

5. The timepiece according to claim 4; wherein the sensing means comprises an inverter circuit having its switching threshold at the predetermined value.

* * * * *